US005834908A

United States Patent [19]

Boland et al.

[11] Patent Number: 5,834,908

[45] Date of Patent: Nov. 10, 1998

[54] INSTANT-ON VAPOR LAMP AND OPERATION THEREOF

[75] Inventors: Steven H. Boland, Glendora; T. Lyle Brady, San Dimas, both of Calif.

[73] Assignee: BHK, Inc., Claremont, Calif.

[21] Appl. No.: 647,836

[22] Filed: May 15, 1996

Related U.S. Application Data

[63] Continuation-in-part of Ser. No. 503,623, Jul. 18, 1995, abandoned, which is a continuation of Ser. No. 341,694, Nov. 15, 1994, abandoned, which is a continuation of Ser. No. 201,060, Feb. 24, 1994, abandoned, which is a continuation of Ser. No. 47,168, Apr. 14, 1993, abandoned, which is a continuation of Ser. No. 702,417, May 20, 1991, abandoned.

[51] Int. Cl.[6] ..... G05F 1/00

[52] U.S. Cl. ..... 315/307; 315/115; 315/117; 315/49; 313/547

[58] Field of Search ..... 315/112–118, 151–158, 315/49, 307–309, DIG. 4; 313/547, 550, 619

[56] References Cited

U.S. PATENT DOCUMENTS

| | | | |
|---|---|---|---|
| 3,457,454 | 7/1969 | Boland | 315/115 |
| 3,686,529 | 8/1972 | Boland | 315/115 |
| 4,101,807 | 7/1978 | Hill | 315/116 |
| 4,190,795 | 2/1980 | Schultheis | 315/158 X |
| 4,467,246 | 8/1984 | Tanaka et al. | 315/158 |
| 4,533,853 | 8/1985 | Hammond et al. | 315/117 |
| 4,672,271 | 6/1987 | Gear et al. | 315/117 |
| 4,978,890 | 12/1990 | Sekiguchi et al. | 315/117 |

*Primary Examiner*—Benny Lee
*Assistant Examiner*—Haissa Philogene
*Attorney, Agent, or Firm*—Boniard I. Brown

[57] ABSTRACT

Operation of a vapor lamp light source for instrumentation utilizes a lamp manager controller for instant-on and precise temperature control to enhance and control output at specified wavelengths by monitoring and discriminating the spectral output of the lamp, and adjusting lamp current and temperature to maintain specific wavelength and light flux. Specific wavelengths can be selected and the wavelength automatically monitored for output level by control of a cold spot by an electrothermal device and a monitor. Lamp temperature, current and flux level at a selected wavelength are controlled.

23 Claims, 6 Drawing Sheets

INSTANT-ON VAPOR LAMP AND OPERATION THEREOF

RELATED APPLICATIONS

This application is a continuation-in-part of application Ser. No. 08/503,623 filed Jul. 18, 1995, now abandoned, which is a continuation of Ser. No. 08/341,694 filed Nov. 15, 1994, now abandoned, which is a continuation of Ser. No. 08/201,060 filed Feb. 24, 1994, now abandoned, which is a continuation of Ser. No. 08/047,168 filed Apr. 14, 1993, now abandoned, which is a continuation of Ser. No. 07/702,417, filed May 20, 1991, now abandoned.

BACKGROUND OF THE INVENTION

Field of the Invention

The present invention relates generally to vapor-filled or gas-filled lamps for analytical instrumentation in such fields as blood analysis to determine specific constituents and to aid in diagnosis of anomalies such as AIDS, and for detection of gaseous and metallic environmental pollutants, such as mercury, lead, arsenic, selenium, etc. Such applications require that the lamps provide standards of output level and wavelength for comparison and require that lamps closely adhere to specified illumination intensity levels over time. The attainment of required output precision requires control of temperature, current and spectral output.

Illumination sources for instrumentation operating in the visible and ultra-violet wavelengths have traditionally been mercury vapor lamps. Analytical chemistry tests have been devised and instruments designed for determining the reaction of body fluids to specific wavelengths under certain conditions. For example, in a designed kinetics reaction test. of amino acid chemistry, a blood sample is analyzed for specific constituents by adding chemical reactants, and exposing the solution sample to ultra violet light of 350 nanometers wavelength, and observing the time required for the reaction to be completed. Similarly, another test requires a spectral output of 410 nanometers from the light source to determine the extent of an immune deficiency.

Vapor lamps such as those lamps containing mercury, zinc or cadmium are standard sources of ultra violet light. Vapor lamps have evolved to the extent that they are reliable in maintaining the output level—i.e., the illumination intensity. This has been accomplished by a combination of improvements including mounting a lamp in an aluminum heat sink block so that the ambient conditions do not influence the temperature of the lamp itself, because temperature variations can otherwise influence the output level of the lamp. Another means for stabilizing the output has been to regulate the current through the lamp.

In laboratory uses of instruments utilizing mercury vapor lamps, as well as mercury lamps having various gas fills, there is always a need by the end user for higher intensity outputs at specific wavelengths, and for close control of the relative intensity of the mercury and gas fill spectral line emissions. As an example, when higher outputs at 365 nm are required, the user always chooses a phosphor coated lamp that has a broad emission band at about 365 nanometers. In this case, the user may be sacrificing the narrow bandwidth of the mercury emission line at 365 nm for the greater total output from the wide band phosphor emission. Another example is the need for higher 185 or 254 nm outputs that are generally available from mercury lamps operating in the low pressure region. These spectral lines are "resonant" lines which suffer from decreasing output intensities as the lamp operating current and internal temperature are increased above optimum current and temperature. This is the reverse of what would normally be expected.

Laboratory instruments for monitoring and/or measuring environmentally hazardous metals, such as arsenic, lead, selenium, and the like, utilize a method of detecting these materials by utilizing the spectral emissions of the metal to be detected. Thus, the optimum design of an instrument of this type incorporates a metal vapor arc light source utilizing the metal of concern. Generally, a single wavelength of the ionized metal vapor is passed through a cell containing either a liquid or gas in which the metal to be detected is contained. One of the primary difficulties in detecting parts per million (ppm), parts per billion (ppb), and parts per trillion (ppt), levels of these metal contaminants is that the proper spectral light source has not been available. The reason for this is that metal vapor arc lamps of these materials are extremely erratic in their operation, and no methodology or means for precise thermal control has been available.

Detection of a metal in an environment is by observation of the amount of absorbence of spectral emissions from the same metal contained in the vapor lamp that occurs as the emissions pass through an optical cell containing atoms of this same metal. This methodology has been used in the detection and measurement of very small quantities of mercury, zinc and cadmium. The reason that sources incorporating these metals are utilized is that they have very broad thermal operating conditions within which they operate, thereby negating the need for use of thermal control except that determined by the physical construction of the light source itself. Conversely, the reason that low-pressure arc lamps incorporating lead, arsenic, selenium and the like are riot utilized or available is that the specific spectral emission lines of interest are only produced at precise metal vapor pressures within a lamp. Because these metal vapor pressures are controlled and set by the temperature within and about the lamp envelope, and by the current through the metal vapor, precise control of the vapor temperature becomes imperative. The prior art has provided no way to achieve this precise control.

Prior Art

U.S. Pat. No. 3,457,454 to Boland discloses a stable light source, such as a mercury vapor lamp, positioned within a metal block, a heater for the metal block, and a heater control for maintaining the temperature of the block intermediate the temperature of the lamp and the ambient temperature. Typically, a UVP Model 11SC-1 Pen Ray Lamp operates for more than 100 hours by maintaining the block temperature, and thus the lamp temperature, constant to provide a stable emission intensity at 2537 angstroms of +or −¼%.

SUMMARY OF THE INVENTION

The present invention enables vapor pressure within a lamp to be controlled so that operating conditions of the lamp may he altered to achieve specific output. Desired output intensities at 185 and 254 nm resonant lines, as well as at non-resonant lines of mercury lines for any other metal vapor and/or gas fill can be obtained by controlling temperature, pressure within the lamp, and current through the vapor or gas.

The present invention provides advances and improvements in the state of the art by including the provision of an instant-on gas discharge or vapor lamp of high spectral purity and stability which can be switched on and off without time lag, after a particular heat sink temperature is attained, whereby analytical instrumentation using the lamp as a light source is ready for immediate use.

A lamp manager device for housing and controlling the lamp includes electronic circuitry to maintain the temperature of a low pressure mercury lamp, thus to enable the mercury vapor pressure within the lamp to be held at a level such that when current flow is initiated within the lamp, the output intensity immediately rises to its maximum allowable value.

The spectral output, the specific wavelength, is monitored by a transmissive filter in combination with an intensity meter that regulates the output of the lamp through the filter by means of the lamp manager, permitting illumination only at the desired wavelength peak.

The lamp manager also regulates the output of the lamp by sensing the temperature of the block mounting, and regulating the current through the heater element to compensate for temperature changes that may occur due to the ambient environment and changes in lamp current made by the lamp manager.

The present invention incorporates three separate, but interdependent, operating controls: a heater control, a thermoelectric device or cooling, heating control, and a lamp current control. These controls maintain the operating temperature, and thereby the metal vapor pressure inside the lamp body, at the precise value required to achieve production of the specific spectral wavelength of interest from the metal vapor. In addition, a separate environmental temperature control that completely surrounds the lamp body is sometimes required to thermally isolate the lamp body from surrounding ambient temperature variations.

For precise temperature control, a temperature sensor such as a thermistor or thermocouple, is needed for real time temperature feedback of lamp body temperature to the temperature control circuitry. A separate temperature sensor is used for real time temperature feedback of the environmental temperature control. For optimum operation and for maintaining the intensity of the spectral output constant, a photodiode or light detector means, along with a narrow band filter, is required for real time feedback of the light intensity at the wavelength of interest, to the lamp current control circuitry.

DESCRIPTION OF THE PREFERRED EMBODIMENTS

Figure 1:
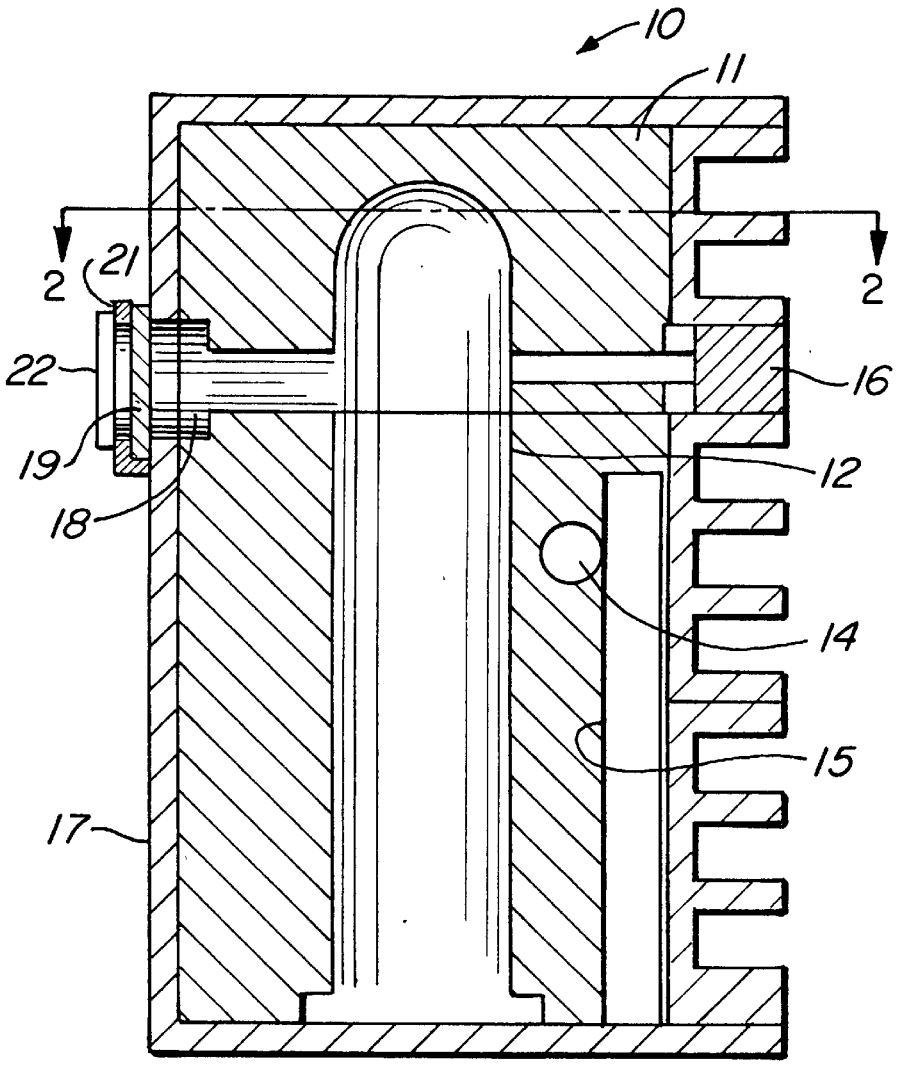
FIG. 1 is a sectional view of a heat sink block mounting for a lamp and associated heater and sensor elements according to the present invention.

Referring to the drawings, the elements of a multi-wavelength lamp assembly 10 are shown in FIG. 1. A finned heat sink block 11 is mounted within box 17, and the lamp 12, the thermistor 14, and cartridge heater 15 are mounted in the block 11. The transmissive filter 19 may be mounted in the box 17 at an output port 18 of the lamp 12. A feedback current sensor element 16 (FIG. 3) may be mounted in block 11 for temperature stability. A transmissive filter 19 may be a spectral filter for selecting the wavelength of the output, or it may be a quartz window for the purpose of keeping atmospheric contaminants away from the lamp, and for the purpose of blocking ambient air flow directly onto the lamp 12. An external bracket 21 may be mounted on the box 17 at the output port 18 for supporting spectral filters that are selective for specific respective wavelengths. A heat source 15 is provided for the mounting block 11 and is operated to maintain the temperature of the block substantially constant. The temperature setting for the block 11 is preferably selected to be 70 degrees centigrade. In a typical unit utilizing a mercury-argon lamp, the lamp and block temperature is 70 C. Typically, the cartridge heater 15 may be an electric resistance heater or other heating device utilizing a control circuit later described with reference to FIG. 3. The heating element 15 is preferably positioned in an opening centrally located in the block to provide maximum heat transfer. The control circuit for the heater includes a thermistor which may be mounted in an opening 14 in the block 11. Forced air cooling may be incorporated in the temperature control system by forcing air against the cooling fins of the block 11. Otherwise, normal convection currents in the instrumentation will tend to flow through the fins for normal cooling.

Figure 2:
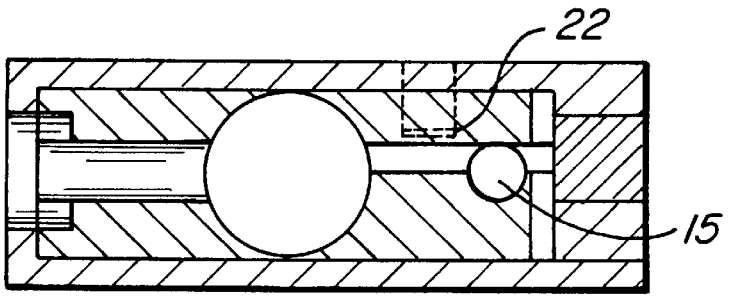
FIG. 2 is a sectional view taken at line 2—2 in FIG. 1.

The light source of the invention is intended to be used with any vapor or gas discharge and arc discharge lamps and may contain glowing gas discharges including mercury, zinc, sodium, cadmium, argon, neon, etc. A preferred form of lamp structure is shown in FIGS. 1 and 2. The location of a thermoelectric device (TED) and associated thermal control elements for wavelength selection and control are indicated for an optimum cold spot.

Referring to FIG. 2, thermistor 14 is inserted into bore 22 and into heater 15. This arrangement provides good control of the lamp temperature for stable operation.

Figure 3:
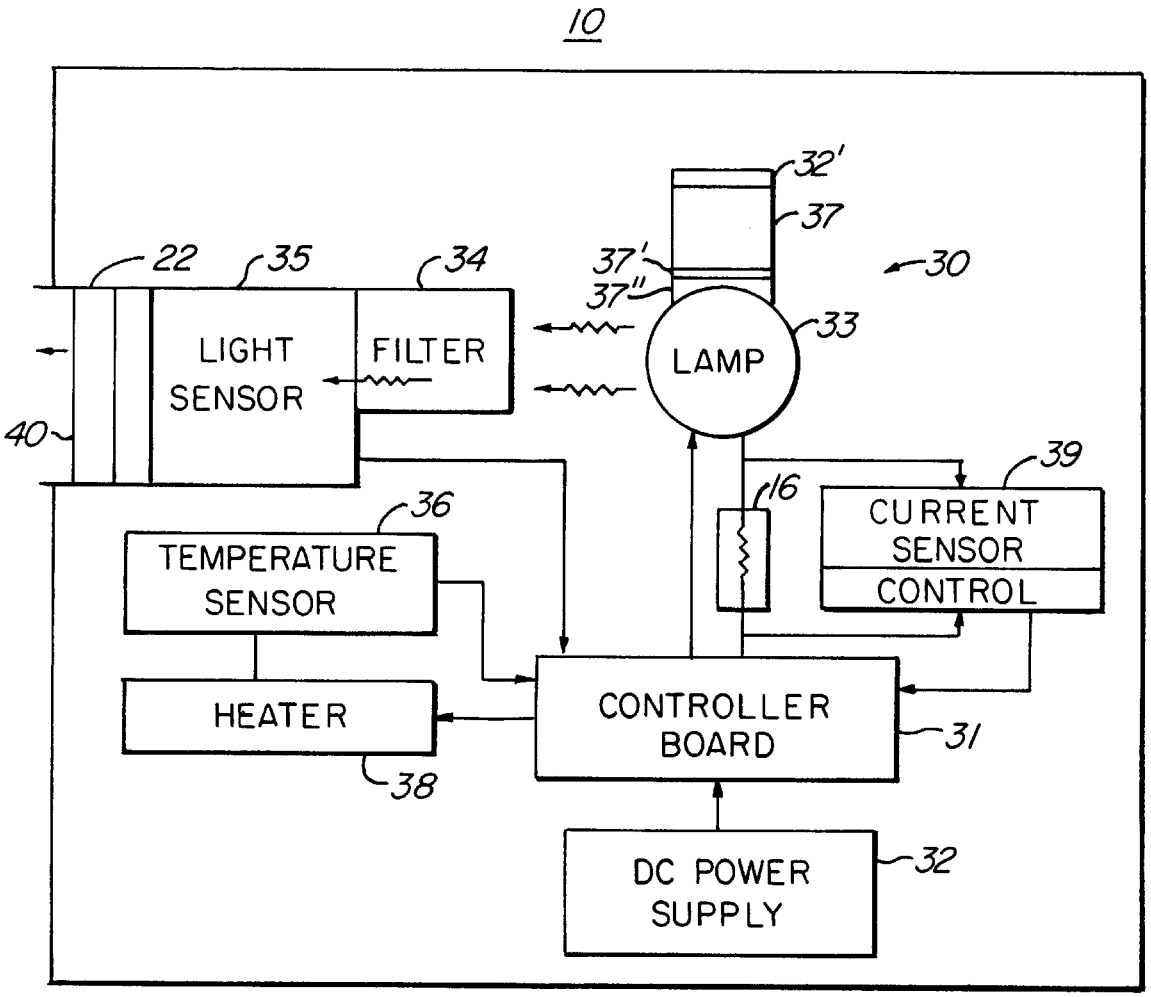
FIG. 3 is a functional flow diagram.

Referring to FIG. 3, the lamp manager board 31 for the lamp 33 includes the power supply 32 which receives power from the AC line. The lamp manager board 31 may be a printed circuit board attached to a box holding block 11 (FIG. 1). The lamp manager board 31 controls the heater 38 current in response to temperature changes of the thermistor sensor 36 to maintain the lamp 33 and the block 11 at a constant temperature. Such a control loop is well known in the temperature control art, and therefore is not discussed further herein. The lamp manager board 31 also adjusts the current through the lamp 33 to stabilize the output of the lamp 33 by maintaining a constant current output as sensed by a current sensor 39. This current sensor uses a sensing resistor in the anode circuit of the lamp 33 so that any change in current changes the voltage drop across the resistor, resulting in a feedback voltage to the lamp manager 31 which corrects the power to the lamp 33. Current regulating means, well known in the art, can be used in the lamp manager board 31 for correcting the lamp 33 current in response to the current sensor 39 output. Finally, the spectral output of the lamp 33 is controlled by another correction loop through the lamp manager board 31. This loop is an optical loop which looks at the output of the lamp 33 through a spectral filter 34. If the lamp 33 output is in the pass band of the spectral filter 34, and the intensity is at the correct level, as measured by a light sensor or photometer 35, the current to the lamp 33 is maintained by the lamp manager board 31. If the spectral output is more or less than the specified level, the current to the lamp 33 is adjusted by the lamp manager board 31. It will readily be understood that the spectral output wavelength can be discriminated by proper choice of filter 34—i.e., the output is coherent about the filter wavelength. Other wavelengths are attenuated by the filter.

In testing for environmental contamination by a metal such as lead, arsenic, mercury, etc., the filter 34 may be a cell containing molecules of a metal that is the same as the environment contaminant metal of interest. When the lamp 10 is directed to a contaminated environment, a change in lamp current will be noted because of light flux absorption, at the wavelength of the metal in the cell 34, by the external environment.

In order to provide a choice of wavelengths output from the lamp 33, the thermoelectric device 37, which is preferably a Peltier solid-state cooler, is in thermal contact with a "cold spot" of the internal vapor, and alters the gas pressure within the lamp to enhance specific wavelengths. An associated heater 37 between the thermoelectric device and the lamp envelope, in combination with electronic temperature control circuits, maintains the desired "cold spot" temperature.

Figure 4:
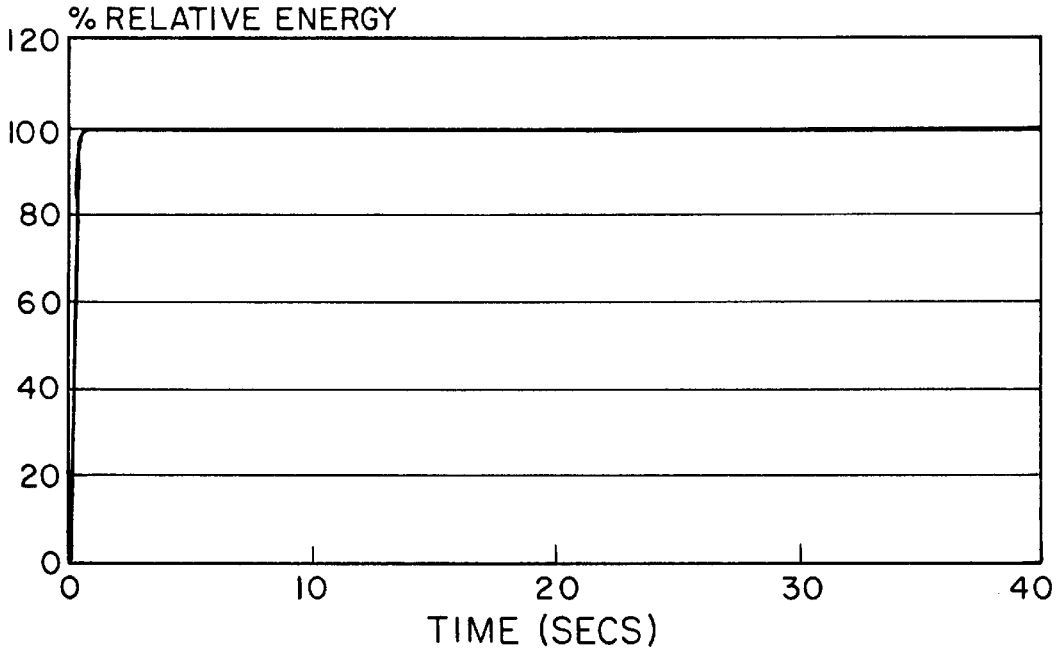
FIGS. 4 and 5 are graphic representations of warmup characteristics of lamps according to the invention.
Figure 5:
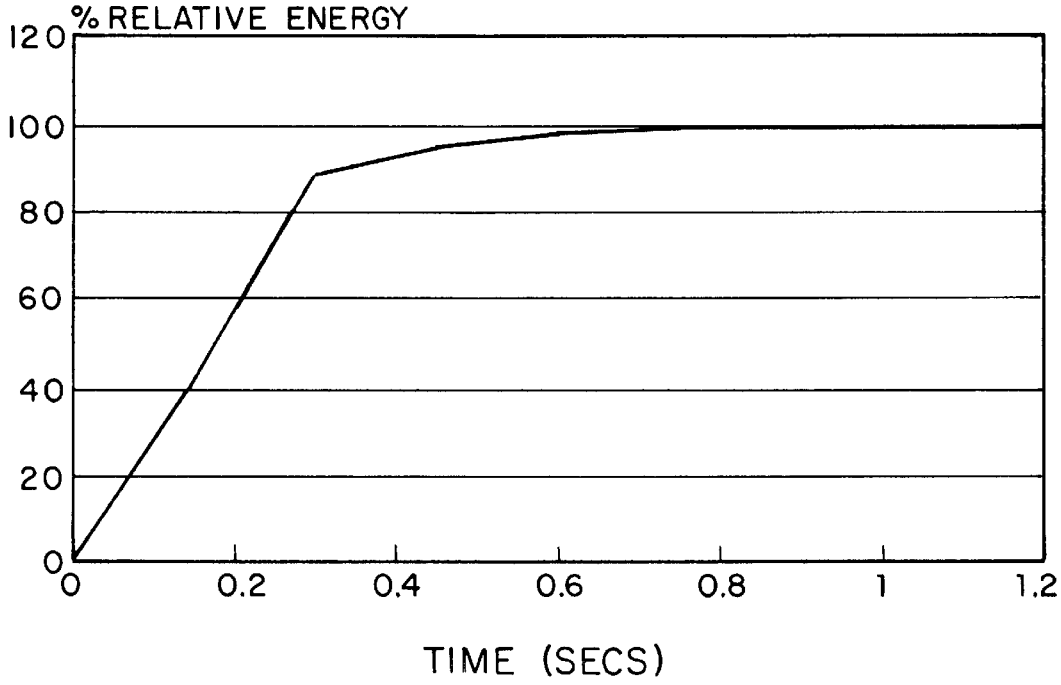

Referring to FIGS. 4 and 5, which show representative warmup characteristics, a 351 nanometer wavelength lamp, with a lamp housing temperature of 70 degrees centigrade, will attain full energy output in 600 to 800 milliseconds. Thus, the block 11 (FIG. 1) temperature should be preheated to approximately 70 degrees centigrade for instant-on operation of the lamp.

Figure 6:
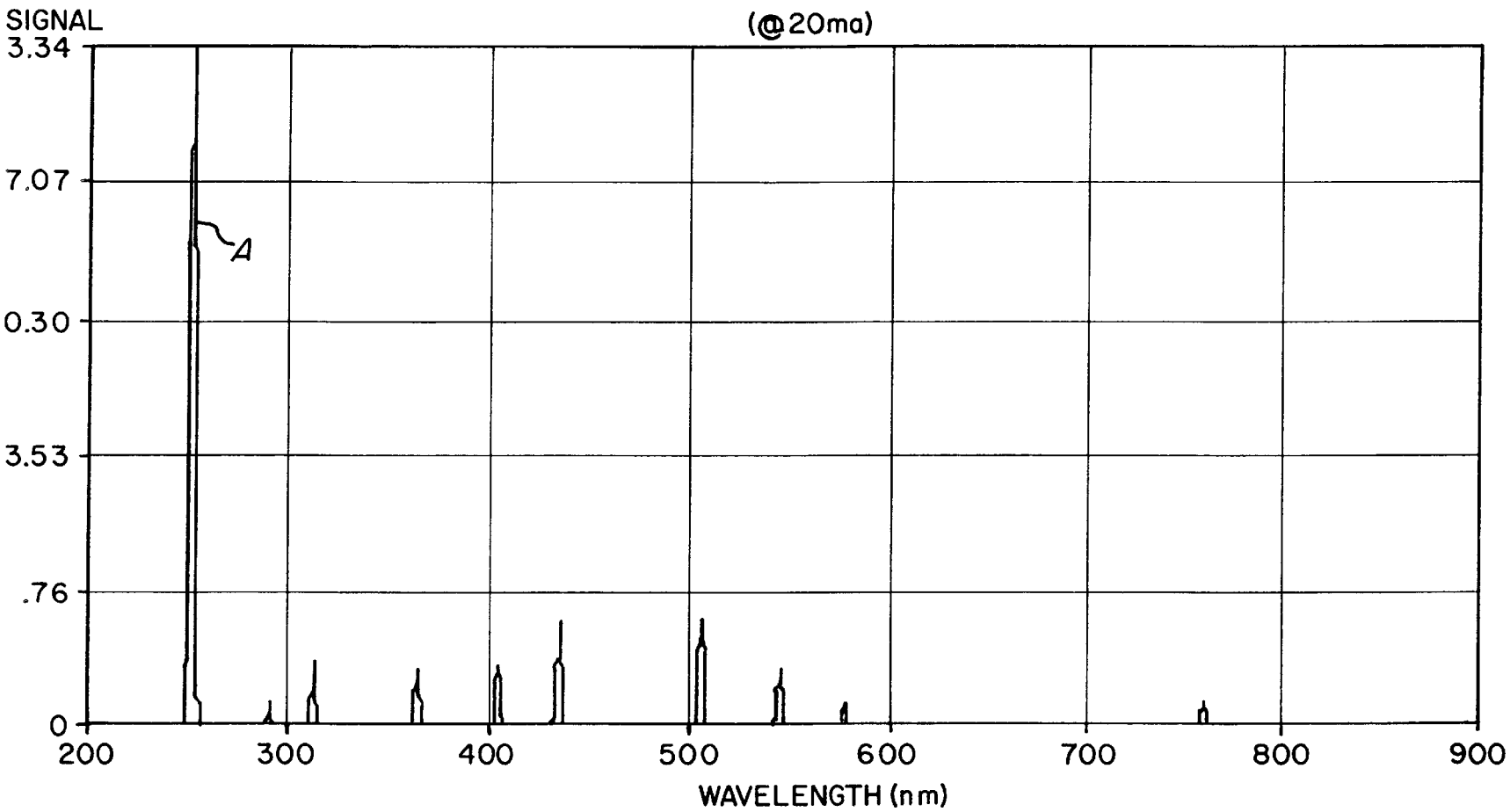
FIG. 6 is a graphical representation of a typical mercury lamp spectral output when operated under normal ambient conditions.

FIG. 6 shows the typical mercury lamp output line (A) at 254 nm when operated under normal ambient conditions. When a thermoelectric device (TED) 37 (FIG. 3) is controlled by the lamp manager and is held in thermal contact with a "cold spot", a new method of lamp operation becomes available. This cold spot temperature can be selected and set by the lamp manager. By setting the "cold spot" at the proper temperature, the 254 nm resonant line output (FIG. 6) can be increased due to the depletion of the mercury vapor, thus correspondingly reducing the reabsorption of the 185 and 254 nm photons by mercury atoms. By controlling this cold-spot temperature in correlation with the current passing through the lamp, the intensity of the spectral lines can be increased to their maximum, which occurs near the point of mercury starvation of the lamp. This enables the intensity of these lines to be varied over the operating current range of the lamp without the normal fall-off of intensity experienced from low intensity mercury lamps operated under uncontrolled ambient conditions.

When the cold spot is brought to and held to some higher temperature such as 200 degrees centigrade, yet another mode of operation becomes available, this being the region between low and medium pressure operation of mercury lamps. In this region, the vapor pressure is sufficiently high that the resonant line outputs at 185 and 254 nanometers becomes severely suppressed and broadened. At the same time, the 365 nanometer line, as well as all other non-resonant lines, increase in intensity in direct relation to the lamp current. When the cold-spot temperature is held constant, in conjunction with the lamp current, the output of the 365 nanometer line can be varied and controlled by the lamp current.

In addition, by setting the cold spot temperature to the correct value, the 365 nanometer line intensity can be increased by as much as 2 to 10 times the intensity available when the lamp is operated in the normal low-pressure mode.

Control of the cold spot must be done carefully and precisely in the region between low and medium pressure operation. In order to achieve the proper control, a heater is provided between the lamp cold spot and the thermoelectric device (TED). A temperature measuring device such as a thermistor is located between the heater and cold spot to provide real-time temperature control. As the lamp current is increased, to provide more 365 nm output the heater current is decreased, in order to maintain the cold spot at the set temperature.

Figure 7:
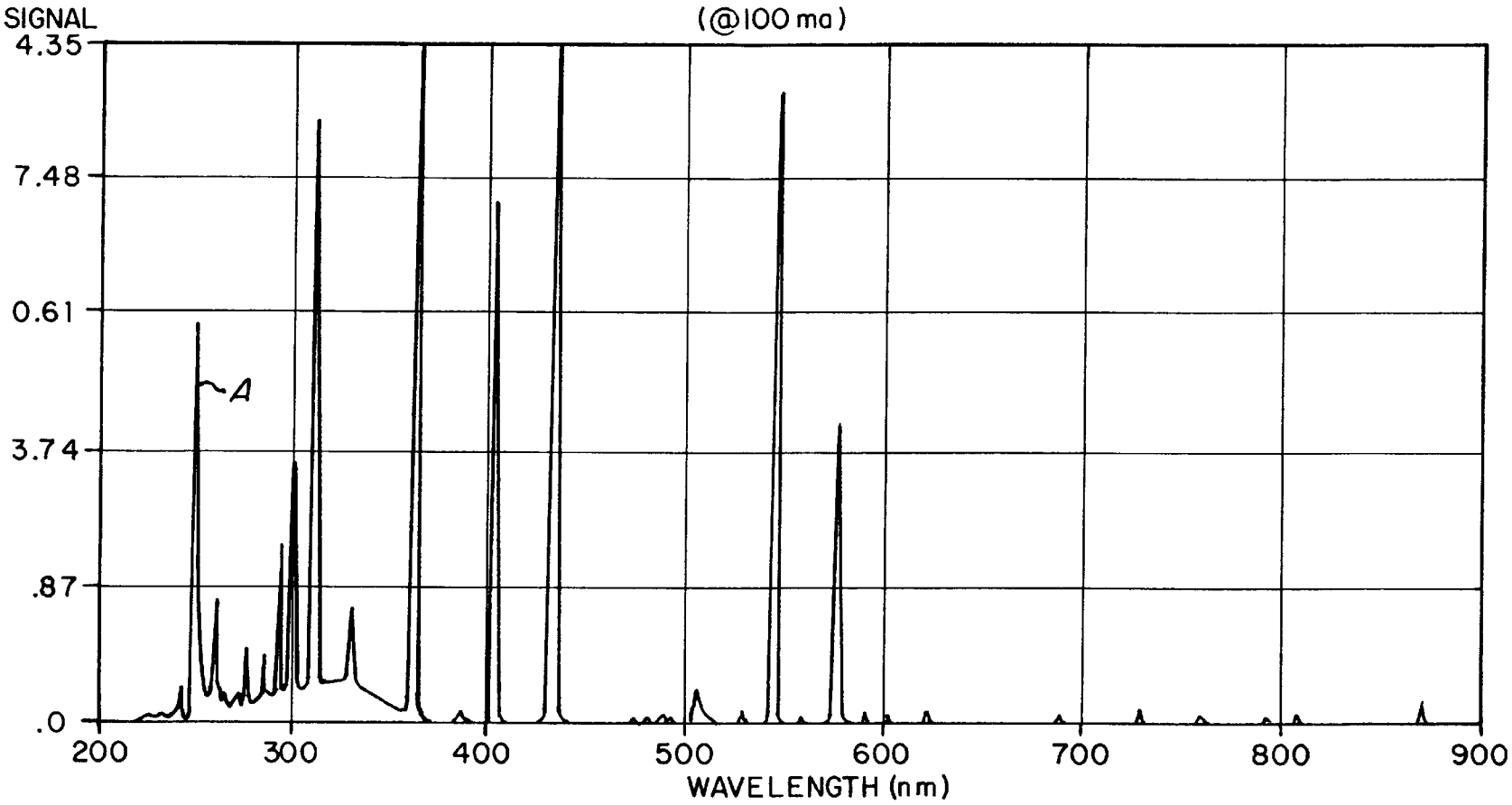
FIG. 7 is a graphical representation of a typical lamp operating at a higher temperature with the intensity levels of the 254 and 365 nm spectral emission lines reversed.

When the cold spot is brought to and held to some higher temperature such as 200 degrees centigrade, yet another mode of operation becomes available. This is in the region between low and medium pressure operation mercury lamps. In this region, the vapor pressure is sufficiently high that the resonant line outputs at 185 and 254 nanometers becomes severely suppressed and broadened. At the same time, the 365 nanometer line and all other non-resonant lines increase in intensity (FIG. 7). When the cold-spot temperature is held constant in conjunction with the lamp current, the output of the 365 nanometer line can be varied and controlled by the lamp current control 39 (FIG. 3).

In addition, by setting the cold-spot temperature to the correct value, the 365 nanometer line intensity can be increased by as much as 2 to 10 times the intensity available when the lamp is operated in the normal low-pressure mode.

Control of the cold spot must be done carefully and precisely in the region between low and medium pressure operation. In order to achieve proper control, a heater 37 is preferably provided, and is located between the lamp cold spot and the thermoelectric device (TED) 37. A temperature measuring device, such as a thermistor 37, is located between the heater and cold spot to provide real-time temperature control.

As the lamp current is increased to provide more 365 nm output, the heater current is decreased to maintain the cold spot at the set temperature.

Figure 8:
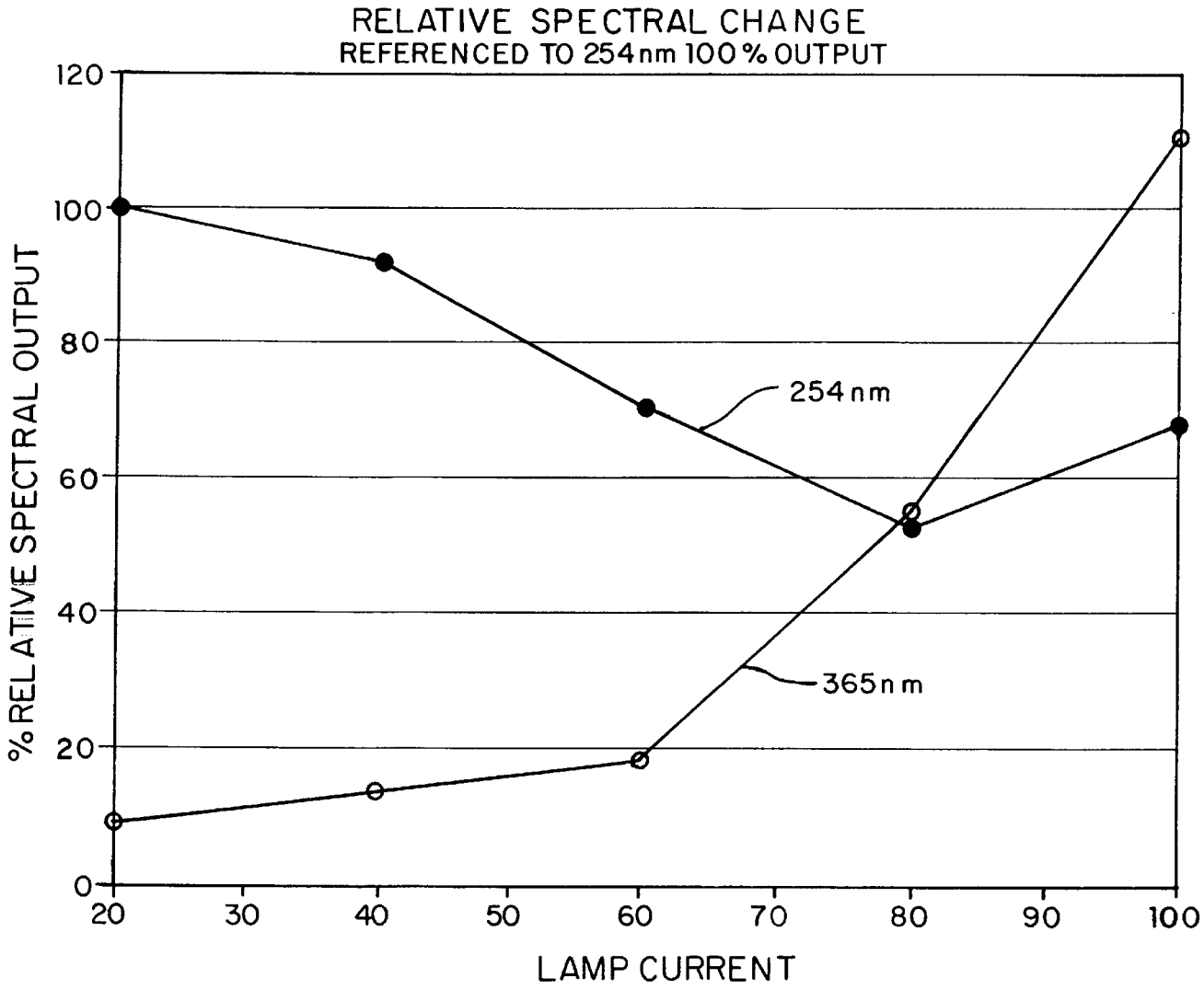
FIG. 8 is a graphical representation of the changing relationship between 254 and 365 spectral lines as lamp current and operating temperature are increased.

FIG. 7 shows the lamp of FIG. 6 operating at a higher temperature when the intensity levels of the 254 and 365 nm spectral emission lines have been reversed. FIG. 8 shows the changing relationship between these two spectral lines as lamp current and operating temperature are increased. It will thus be seen that, by adjusting the temperature and operating current of the lamp by controls at the lamp manager, the output of the lamp can be set for a specific light flux level at a specific wavelength.

Thus there has been shown and described a novel instant-on vapor lamp and operation thereof which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventors claim:

1. A light source for instrumentation and the like, having instantaneous turn-on and substantially constant spectrally coherent output level, comprising:

a vapor lamp, a heat sink block, said block having a light passage communicating with said lamp for passage of radiation from the lamp to said block, means for heating said block, control means for the heater means, including temperature responsive means on said block to maintain the block adjacent the temperature responsive means substantially at a predetermined temperature, output level control means for adjusting illumination output of the lamp, including light responsive means to receive illumination from said lamp and to control current through the lamp in accordance with illumination output level, said illumination output level control means includes a spectral filter for discriminating output wavelength, whereby illumination output is maintained at a predetermined wavelength, and lamp current control means for adjusting heater current through said lamp in response to said temperature responsive means and said illumination output level control means, whereby the illumination output level of said vapor lamp is instantly set and maintained by controlling lamp temperature and current.

2. A light source according to claim 1, wherein:

said light source being a cold cathode arc-discharge lamp for producing radiation at substantially constant intensity, and said heater control means is adapted to maintain said lamp at a temperature of 70 ° C.

3. A light source according to claim 1, and further comprising:

means for directing the light source to a contaminated environment, and means for observing any change in lamp current resulting from light flux absorption by the environment.

4. A light source according to claim 3, wherein:

said lamp contains a gaseous vapor material containing a low atomic number element selected among zinc, cadmium, nickel, nitrogen, sodium, argon, and mercury.

5. A method for testing for environmental contamination by a metal such as lead, arsenic, mercury, or zinc, comprising the steps of:

providing a light source as defined in claim 1, providing a filter cell containing molecules of a metal for which the environment is to be tested, directing the light source to a contaminated environment, and observing any change in lamp current resulting from light flux absorption by the environment at the wavelength of the metal in the cell.

6. A light source for instrumentation and the like, having instantaneous turn-on and substantially constant spectrally coherent-output level, comprising:

a vapor lamp, a power supply to excite and provide current to said vapor lamp, current sensing means to sense changes in anode current in the vapor lamp, said current sensing means being connected to said power supply and to the lamp and being adapted to compensate for changes in said anode current, a heat sink block, said block having a light passage communicating with said lamp for passage of radiation from the lamp to said block, means for heating said block, control means for the heater means, including temperature responsive means on said block to maintain the block adjacent the temperature responsive means substantially at a predetermined temperature, output level control means for adjusting the illumination output of the lamp, including light responsive means to receive illumination from said lamp and to control current through the lamp in accordance with illumination output level, control means for maintaining the light output level of the lamp, said control means including a spectral filter and light responsive means to receive illumination from the lamp and maintain a constant current to the lamp, lamp temperature control means including a temperature sensor and a heater connected to said power supply for adjusting the current through said heater in response to changes in temperature of said lamp, whereby lamp temperature and a predetermined output level of spectrally coherent illumination, are instantly set and maintained, and lamp current control means for adjusting heater current through said lamp in response to said temperature responsive means and said illumination output level control means, whereby the illumination output level of said vapor lamp is instantly set and maintained by controlling lamp temperature and current.

7. A light source for instrumentation and the like, having instantaneous turn-on and substantially constant spectrally coherent output level, comprising:

a vapor lamp, a heat sink block, said block having a light passage communicating with said lamp for passage of radiation from the lamp to said block, means for heating said block, heater control means adapted to maintain said lamp at a temperature of 70° C., said light source being a cold cathode arc-discharge lamp for producing radiation at substantially constant intensity, control means for the heater means, including temperature responsive means on said block to maintain the block adjacent the temperature responsive means substantially at a predetermined temperature, output level control means for adjusting the illumination output of the lamp, including light responsive means to receive illumination from said lamp and to control current through the lamp in accordance with illumination output level, means for maintaining a thermoelectric device in thermal contact with a cold spot, whereby resonant line outputs are increased by depletion of mercury vapor in the lamp to correspondingly reduce reabsorption of photons by mercury atoms, means for controlling cold spot temperature in correlation with the current passing through the lamp to allow the intensity of spectral lines to increase to their maximum near the point of mercury starvation of the lamp to enable variation of the intensity of said spectral lines over the operating current range of the lamp without fall-off of intensity, means for maintaining the cold spot at a temperature in a region between low and medium pressure mercury lamps, whereby vapor pressure is sufficiently high that the resonant line outputs at 185 and 254 nanometers become suppressed and broadened, while a 365 nanometer line and other non-resonant lines increase in intensity, means for maintaining the cold spot temperature constantly in correlation with the lamp current, means for varying output of the 365 nanometer line by adjusting lamp current, means for setting the cold spot temperature to a predetermined value at which the 365 nanometer line intensity is two to ten times the intensity available in a normal low-pressure operating mode, means for precisely controlling the cold spot temperature in the region between low and medium pressure operation by heating between the lamp cold spot and the thermoelectric device, and lamp current control means for adjusting heater current through said lamp in response to said temperature responsive means and said illumination output level control means, whereby the illumination output level of said vapor lamp is instantly set and maintained by controlling lamp temperature and current.

8. A light source according to claim 7, and further including the step of:

providing real-time temperature control decreasing the heater current to maintain the cold spot at the set temperature as the lamp current is increased to provide more 365 nm output.

9. A light source according to claim 7, wherein there is no fall-off of intensity caused by low intensity mercury lamps operating under uncontrolled ambient conditions.

10. A method according to claim 7, and further including:

measuring temperature between the heater and the cold spot to provide real-time temperature control, and decreasing heater current to maintain the cold spot at the predetermined temperature with lamp current increase to provide increased 365 nm output.

11. A method of operation of a vapor lamp for instantaneously available output at a specified level, comprising the steps of:

providing a vapor lamp as defined in claim 7, measuring the illumination output of the lamp at a specified level, and adjusting electrode power to the vapor lamp to maintain the specified level.

12. A method according to claim 11, and further comprising:

discriminating the output wavelength of the lamp by filtering illumination output through a transmissive spectral filter.

13. A method of operation of a vapor lamp to provide a wavelength selective mode of operation, comprising the steps of:

maintaining a thermoelectric device in thermal contact with a cold spot at a selected temperature by setting the cold spot at said temperature to increase the 185 and 254 resonant line outputs due to the depletion of mercury vapor, while correspondingly reducing the reabsorption of 185 and 254 nm photons by mercury atoms, controlling the temperature of the cold spot in correlation with current through the lamp to allow the intensity of the spectral lines to increase to the maximum near the point of mercury starvation of the lamp to enable variation of the intensity of said spectral lines over the operating current range of the lamp without fall-off of intensity, maintaining the cold spot at a higher temperature in a region between low and medium pressure operation mercury lamps, whereby the vapor pressure is sufficiently high that the resonant line outputs at 185 and 254 nanometers become suppressed and broadened, while a 365 nanometer line and other non-resonant lines increase in intensity, maintaining the cold spot temperature constant in correlation with the lamp current, varying the output of the 365 nanometer line by adjusting the lamp current, setting the cold spot temperature to the predetermined value at which the 365 nanometer line intensity is two to ten times the intensity available in a normal low-pressure operating mode, and controlling precisely the cold spot temperature in the region between low and medium pressure operation by heating between the lamp cold spot and the thermoelectric device.

14. A method of operation of a metal vapor lamp to provide a precise mode of operation, comprising the steps of:

setting a cold spot at a predetermined temperature at about the melting point of the metal, maintaining a thermoelectric device in thermal contact with the cold spot, controlling the predetermined cold spot temperature in correlation with the current passing through the lamp to enable the intensity of the spectral output to be increased and held at a maximum without thermal run-away and without radical lamp operation experienced without precise cold spot temperature control, controlling lamp spectral emission output by adjusting the lamp current, and controlling precisely the cold spot temperature in the region required for stable lamp operation by heating between said cold spot and the thermoelectric device, while measuring temperature between the heater and the cold spot to provide real-time temperature control.

15. A method according to claim 14, and further comprising:

bringing and holding the cold spot to a constant higher temperature in correlation with the lamp current, at which higher temperature other modes of operation of the lamp can be provided.

16. A method according to claim 14, wherein said metal vapor lamp utilizes a metal selected among lead, arsenic, and selenium.

17. A method according to claim 14, and further comprising:

decreasing heater current to maintain the cold spot at the predetermined temperature with increase of lamp current to provide increased spectral line output.

18. A lamp adapted for pre-heating to provide instantaneous energizing and provide substantially constant spectrally coherent output, said lamp comprising:

a vapor lamp operable at such an elevated temperature that vapor pressure is stabilized and ion flow is controlled to produce radiation of predetermined wavelength, heat sink means defining first, second and third socket openings, and a passage for directing radiant energy from the lamp and through the heat sink means, electrical heater means connected with the second socket opening for pre-heating the lamp to provide said elevated temperature prior to operation of the lamp, said elevated lamp temperature being substantially that of the heat-sink means, thermistor means connected with said third socket opening and responsive to temperature changes in the temperature of said heat sink means to provide accurate control of said electrical heater means, and illumination control means for maintaining the output of the lamp at substantially constant wavelength and intensity.

19. A lamp according to claim 18, wherein:

said illumination control means comprises a spectral filter, said spectral filter being disposed between the lamp and said light responsive means to expose the light responsive means only to light of the wavelength passed by the spectral filter, means controlled by said light responsive means for adjusting current through the lamp to maintain lamp output substantially constant.

20. A lamp according to claim 18, wherein:

said heat sink means comprises a heater block, and further including:

cooling fins on said heater block for air cooling of the heater block.

21. A lamp according to claim 18, wherein:

said elevated temperature to which said heat sink is elevated is 70° C., and the lamp is a mercury-argon lamp.

22. A method of operating a glow discharge lamp to provide substantially instantaneously available output at a predetermined level, said method comprising:

preheating the lamp to a predetermined operating temperature, applying predetermined anode power, current and voltage levels to the lamp upon said predetermined lamp output level being attained, measuring illumination output of the lamp at said levels, and adjusting said anode power to maintain said specified levels, and discriminating the output wave length by providing transmissive spectral filter means.

23. The method according to claim 22, and further including:

providing said vapor lamp with glowing gas discharge by material selected from the group comprising mercury, zinc, sodium, cadmium, argon, and neon.

* * * * *